US010455998B2

(12) United States Patent
Kim et al.

(10) Patent No.: US 10,455,998 B2
(45) Date of Patent: Oct. 29, 2019

(54) VACUUM CLEANER

(71) Applicant: SAMSUNG ELECTRONICS CO., LTD., Suwon-si, Gyeonggi-do (KR)

(72) Inventors: Hooi-joong Kim, Yongin-si (KR); Jae-ik Park, Daegu (KR); Won-jun Jang, Suwon-si (KR); Ho Choi, Hwaseong-si (KR)

(73) Assignee: SAMSUNG ELECTRONICS CO., LTD., Suwon-si (KR)

( * ) Notice: Subject to any disclaimer, the term of this patent is extended or adjusted under 35 U.S.C. 154(b) by 313 days.

(21) Appl. No.: 15/477,531

(22) Filed: Apr. 3, 2017

(65) Prior Publication Data

US 2018/0020891 A1 Jan. 25, 2018

(30) Foreign Application Priority Data

Jul. 22, 2016 (KR) ..... 10-2016-0093260

(51) Int. Cl.

| | |
|---|---|
| ***A47L 9/00*** | (2006.01) |
| ***A47L 9/10*** | (2006.01) |
| ***A47L 9/16*** | (2006.01) |
| *A47L 5/28* | (2006.01) |
| *A47L 9/22* | (2006.01) |

(52) U.S. Cl.

CPC ..... *A47L 9/0081* (2013.01); *A47L 9/0072* (2013.01); *A47L 9/10* (2013.01); *A47L 9/1683* (2013.01); *A47L 5/28* (2013.01); *A47L 9/22* (2013.01)

(58) Field of Classification Search

CPC ..... A47L 5/28; A47L 9/0072; A47L 9/0081; A47L 9/10; A47L 9/1683; A47L 9/22

See application file for complete search history.

(56) References Cited

U.S. PATENT DOCUMENTS

| | | | | |
|---|---|---|---|---|
| 5,293,664 | A * | 3/1994 | Lim | A47L 9/22 15/326 |
| 5,720,074 | A * | 2/1998 | Lee | A47L 9/0081 15/326 |
| 5,991,969 | A * | 11/1999 | Lee | A47L 9/0081 15/326 |
| 6,052,862 | A * | 4/2000 | Lowery | A47L 9/26 15/323 |
| 6,932,188 | B2 * | 8/2005 | Ni | A47L 9/0081 15/326 |

(Continued)

FOREIGN PATENT DOCUMENTS

| | | |
|---|---|---|
| JP | 3012729 | 12/1999 |
| JP | 2000-354562 | 12/2000 |

(Continued)

*Primary Examiner* — Marc Carlson

(74) *Attorney, Agent, or Firm* — Staas & Halsey LLP

(57) ABSTRACT

A vacuum cleaner is provided, which includes a main body; a dust collection unit arranged in the main body to collect dusts from air that flows into the main body along an intake passage; and a suction unit arranged at a downstream that is lower than a location of the dust collection unit on the intake passage to provide a suction force, wherein the suction unit includes a suction force generator, an exhaust passage configured to switch a discharge direction of the air that has passed through the suction force generator at least twice, and a plurality of sound-absorbing members arranged on the exhaust passage to pass the air therethrough.

17 Claims, 10 Drawing Sheets

(56) References Cited

U.S. PATENT DOCUMENTS

| | | | | |
|---|---|---|---|---|
| 7,225,504 | B2 * | 6/2007 | Ni | A47L 9/0081 15/326 |
| 7,475,449 | B2 * | 1/2009 | Lee | A47L 9/00 15/326 |
| 7,788,763 | B2 * | 9/2010 | Hwang | A47L 9/0081 15/326 |
| 2007/0136982 | A1 | 6/2007 | Lee et al. | |
| 2016/0113463 | A1 * | 4/2016 | Hyun | A47L 9/1625 55/337 |

FOREIGN PATENT DOCUMENTS

| | | | |
|---|---|---|---|
| JP | 2004-81428 | | 3/2004 |
| JP | 4911179 | | 1/2012 |
| JP | 201464647 | A * | 4/2014 |
| KR | 1997-0009718 | | 3/1997 |
| KR | 10-0205687 | | 7/1999 |
| KR | 10-0504856 | | 7/2005 |
| KR | 10-0710232 | | 4/2007 |
| KR | 10-0725515 | | 6/2007 |
| KR | 10-2010-0117817 | | 11/2010 |
| KR | 10-1199739 | | 11/2012 |
| KR | 10-1436631 | | 9/2014 |
| KR | 10-2015-0000530 | | 1/2015 |

* cited by examiner

VACUUM CLEANER

CROSS-REFERENCE TO RELATED APPLICATIONS

This application claims priority from Korean Patent Application No. 10-2016-0093260 filed on Jul. 22, 2016 in the Korean Intellectual Property Office, the disclosure of which is incorporated herein by reference in its entirety.

BACKGROUND

Field

The present disclosure relates to an improved vacuum cleaner that can reduce noise.

Description of the Prior Art

In general, a vacuum cleaner is a device which sucks air on a surface to be cleaned, separates and collects dust or pollutants from the sucked air, and discharges purified air out of a main body.

Such a vacuum cleaner may be classified into a canister type in which a main body and a suction nozzle are separated from each other and are connected to each other through a predetermined tube, and an upright type in which a suction nozzle and a main body are provided in a body.

Recently, with the advent of a robot cleaner that can automatically clean an area to be cleaned through suction of foreign substances, such as dusts, from a bottom while traveling the area to be cleaned by itself even without user's operation and a miniaturized handy cleaner that enables a user to easily perform cleaning in a state where the user holds the cleaner in his/her hand, user's convenience has been increased.

However, the vacuum cleaner has the problem that it generates vibration noise that is generated when vibration, which is generated by a motor of a suction force generator that is driven to generate a suction force, is transferred to a main body of the cleaner and flow noise that is generated due to an air flow during a process in which air that is sucked from the suction force generator is discharged out of the main body of the cleaner, and the use of the motor having a strong suction force to heighten the cleaning efficiency may cause the noise to be increased.

SUMMARY

Exemplary embodiments of the present disclosure overcome the above disadvantages and other disadvantages not described above, and provide a vacuum cleaner that can reduce generated noise while maintaining the level of a suction force.

According to an aspect of the present disclosure, a vacuum cleaner includes a main body; a dust collection unit arranged in the main body to collect dusts from air that flows into the main body along an intake passage; and a suction unit arranged at a downstream that is lower than a location of the dust collection unit on the intake passage to provide a suction force, wherein the suction unit includes a suction force generator, an exhaust passage configured to switch a discharge direction of the air that has passed through the suction force generator at least twice, and a plurality of sound-absorbing members arranged on the exhaust passage to pass the air therethrough.

According to another aspect of the present disclosure, a vacuum cleaner includes a main body; a dust collection unit arranged in the main body to collect dusts from air that flows into the main body along an intake passage; and a suction unit arranged at a downstream that is lower than a location of the dust collection unit on the intake passage to provide a suction force, wherein the suction unit includes a suction force generator and a housing configured to accommodate the suction force generator therein and to discharge the air that is sucked from the suction force generator to an outside, the housing includes a first exhaust passage, a second exhaust passage configured to connect with the first exhaust passage and to switch a direction from the first exhaust passage, and first and second sound-absorbing members arranged on the first and second exhaust passages, respectively, and the first and second exhaust passages are arranged to form a layer along an outer surface of the housing.

Additional and/or other aspects and advantages of the disclosure will be set forth in part in the description which follows and, in part, will be obvious from the description, or may be learned by practice of the disclosure.

BRIEF DESCRIPTION OF THE DRAWING

The above and/or other aspects of the present disclosure will be more apparent by describing certain exemplary embodiments of the present disclosure with reference to the accompanying drawings, in which.

DETAILED DESCRIPTION

Figure 1:
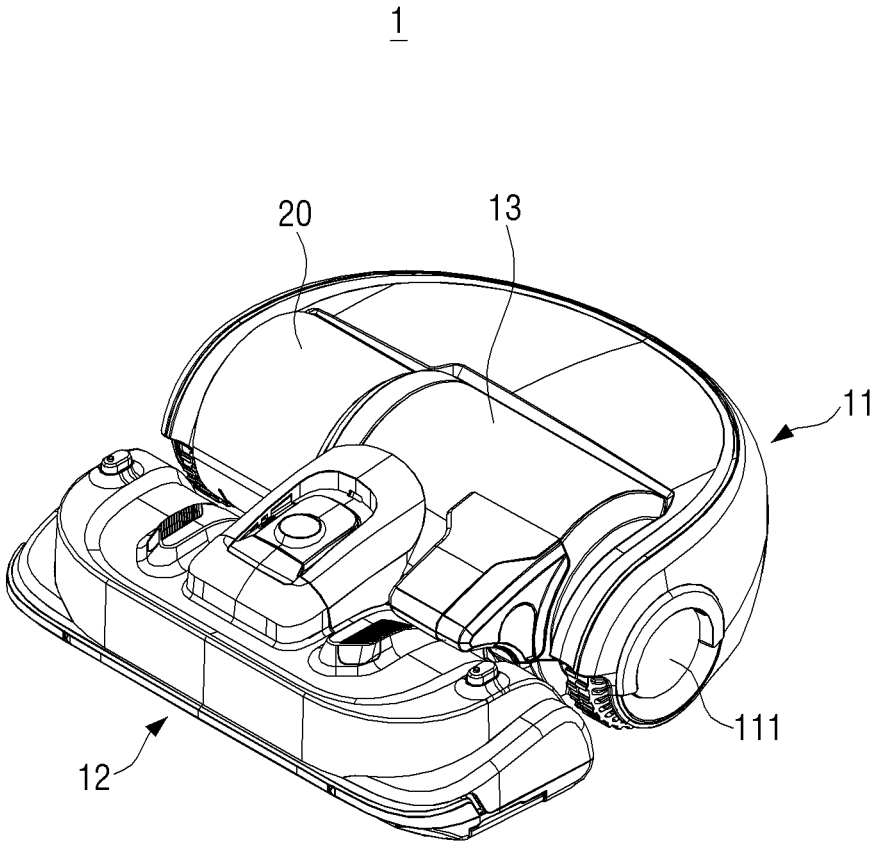
FIG. 1 is a perspective view illustrating an external appearance of a vacuum cleaner according to an embodiment of the present disclosure.

Hereinafter, exemplary embodiments of the present disclosure will be described in detail with reference to accompanying drawings. The following description of the exemplary embodiments is based on the most suitable embodiments in understanding the technical features of the present disclosure. However, the technical features of the present disclosure are not limited by the embodiments to be described, but it is exemplified that the present disclosure may be implemented by the embodiments to be described hereinafter.

Accordingly, those of ordinary skill in the art will recognize that various changes and modifications of the embodiments described herein can be made without departing from the scope and spirit of the present disclosure. In addition, in order to help understanding of the embodiments to be described hereinafter, like drawing reference numerals are used for the like elements, even in different drawings.

FIG. 1 is a perspective view illustrating an external appearance of a vacuum cleaner according to an embodiment of the present disclosure.

Although a vacuum cleaner 1 as illustrated in FIG. 1 exemplifies the shape of a robot cleaner, the vacuum cleaner 1 according to an embodiment of the present disclosure may be a general canister, upright, or handy vacuum cleaner in addition to the robot cleaner.

Referring to FIG. 1, the vacuum cleaner 1 may include a main body 11 and 12, a dust collection unit 13 arranged in the main body 11 and 12, a suction unit 20 connected to the dust collection unit 13, and driving wheels 111 arranged on both sides of the main body 11.

The main body 11 and 12 may include a first main body 11 and a second main body 12.

The dust collection unit 13, the suction unit 20, and the driving wheels 111 are arranged in the first main body 11, and the second main body 12 may include a suction port (not illustrated), a brush unit (not illustrated), a bumper, and a sensor portion. Further, the first main body 11 and the second main body 12 may be formed in a body.

The dust collection unit 13 that is arranged in the first main body 11 may separate pollutants, such as dusts, from air that flows into the first main body 11 along an intake passage to store the separated pollutants therein.

In addition, the dust collection unit 13 may be separated from the first main body 11, and through this, it becomes possible to remove the pollutants that are accumulated in the dust collection unit 13.

The suction unit 20 may provide a suction force to a cleaning surface to be cleaned. The suction unit 20 is connected to the dust collection unit 13, and applies the suction force to the dust collection unit 13 and the suction port of the second main body 12 that connects with the dust collection unit 13.

The suction unit 20 is arranged at a downstream that is lower than a location of the dust collection unit 13 on the intake passage, and thus the pollutants that are included in the air that is sucked through the cleaning surface can be collected through the dust collection unit 13. Purified air that has passed through the dust collection unit 13 may be discharged to an outside through the suction unit 20.

Further, the vacuum cleaner 1 may travel by itself by rotation of the driving wheels 111, and through this, the vacuum cleaner 1 can automatically clean an area to be cleaned through suction of the pollutants, such as dusts, from a bottom even without user's operation.

In addition, the vacuum cleaner 1 may include a controller (not illustrated) for control of the vacuum cleaner 1, a power supply (not illustrated), and a driver. Since such constituent elements are equal or similar to those in the prior art technology, detailed explanation thereof will be omitted.

Figure 2:
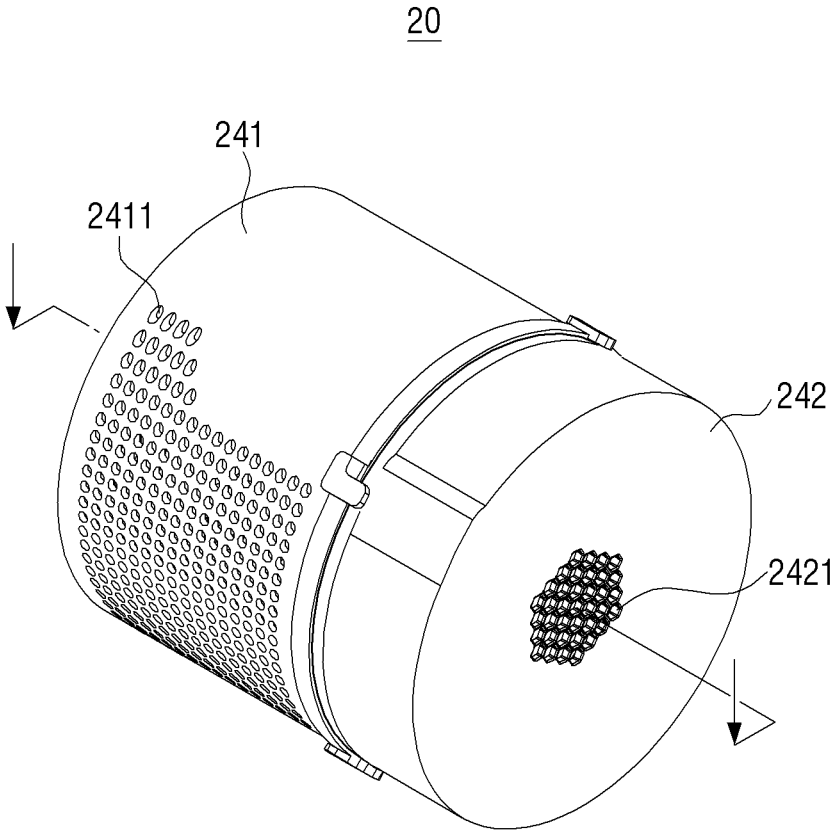
FIG. 2 is a perspective view illustrating a suction unit of a vacuum cleaner illustrated in FIG. 1.
Figure 3:
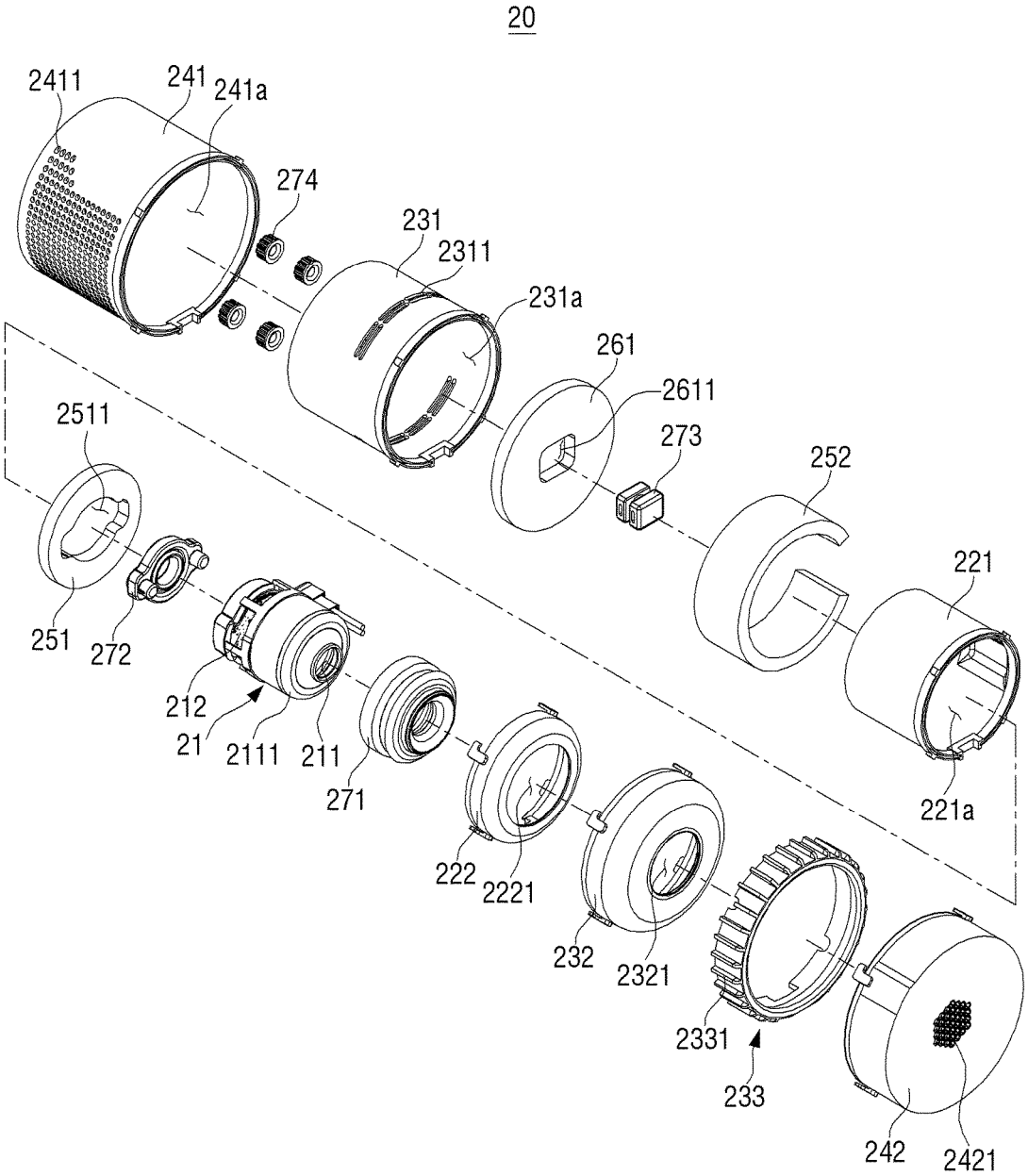
FIG. 3 is an exploded perspective view of a suction unit illustrated in FIG. 2.
Figure 4:
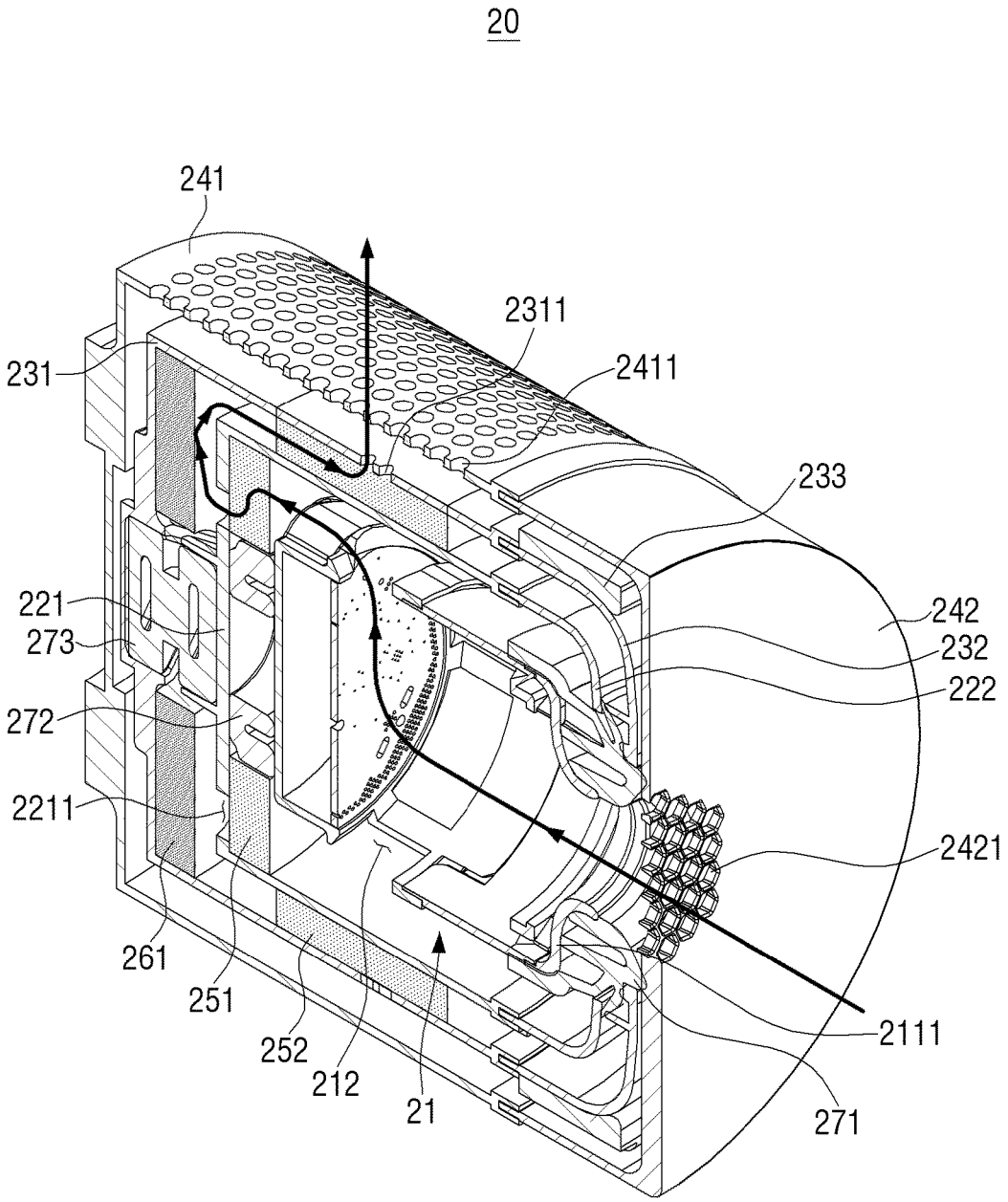
FIG. 4 is a cross-sectional view illustrating a passage of a suction unit illustrated in FIG. 2.
Figure 5:
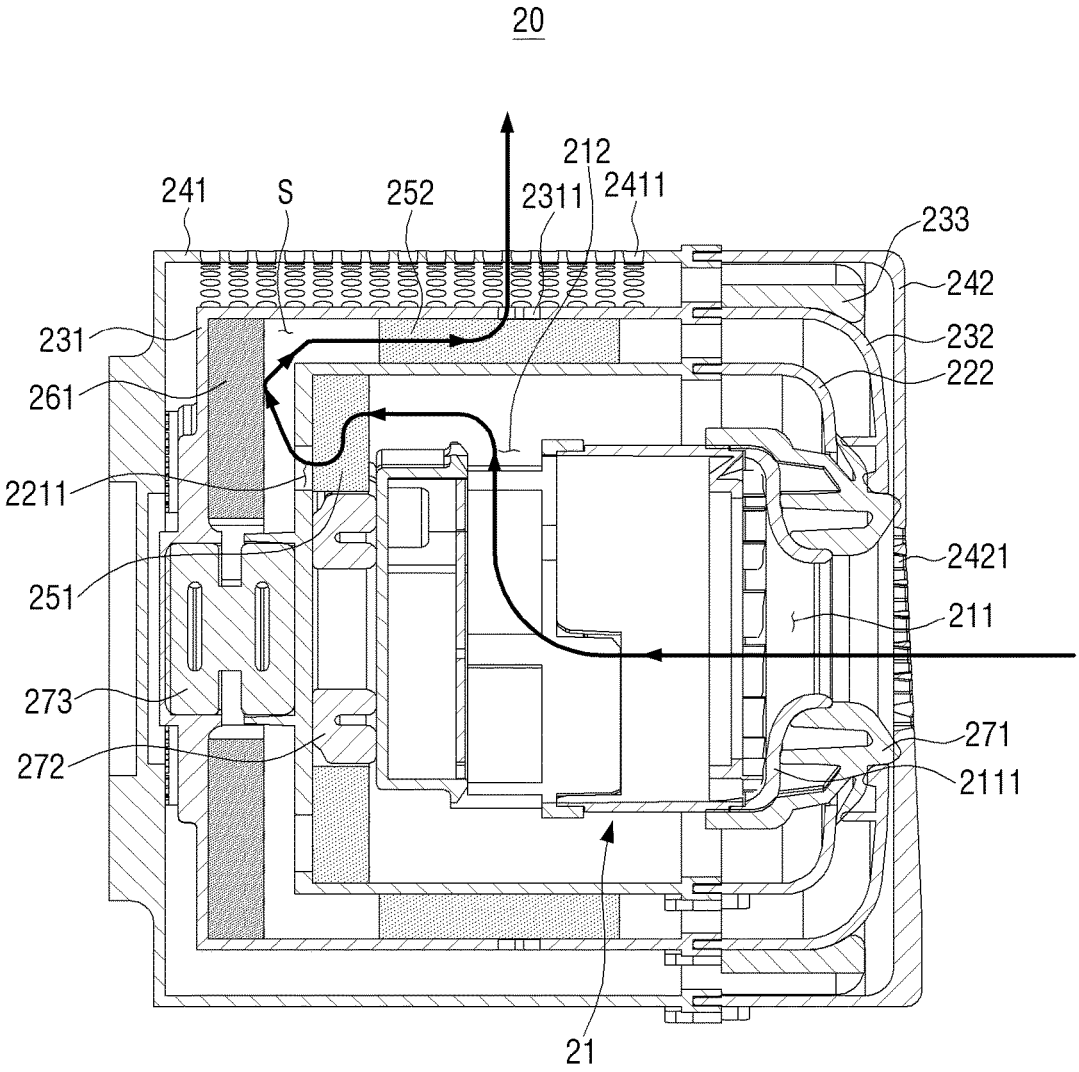
FIG. 5 is cross-sectional view of a passage of a suction unit illustrated in FIG. 4 as seen from a different direction.

FIG. 2 is a perspective view illustrating an external appearance of a suction unit 20 of a vacuum cleaner 1, and FIG. 3 is an exploded perspective view of the suction unit 20. FIGS. 4 and 5 are cross-sectional views of a suction unit 20 for indicating a passage through which the air in the suction unit 20 flows.

In FIGS. 4 and 5, a flow of the air, which flows into the suction unit 20 and is discharged to the outside, is indicated as an arrow.

Hereinafter, with reference to FIGS. 2 to 5, the detailed configuration of the suction unit 20 will be described.

As described above, the suction unit 20 may be arranged at the downstream that is lower than the location of dust collection unit 13 on the intake passage to provide the suction force onto the dust collection unit 13 and the cleaning surface.

The suction unit 20 may include a plurality of housings 221, 231, and 241 configured to successively accommodate the suction force generator 21, a plurality of sound-absorbing members 251 and 252, and a plurality of anti-vibration members 271 to 274.

The suction force generator 21 may generate a suction force for sucking external air of the vacuum cleaner 1 into the main body 11 and 12.

As illustrated in FIG. 3, the suction force generator 21 may be in a cylindrical shape, and may include an impeller (not illustrated), a motor (not illustrated), an impeller cover 2111 including an intake hole 211, and exhaust holes 212 discharging the air that is sucked through the intake hole 211.

The suction force generator 21 may suck the external air into the suction force generator 21 through the intake hole 211 by rotation of the impeller that is connected to the motor.

The air that is sucked into the suction force generator 21 through the intake hole 211 may be discharged through the exhaust holes 212 that are formed on the side surface of the suction force generator 21.

Since the suction force generator 21 is the same as or similar to that in the prior art, detailed explanation thereof will be omitted.

The suction force generator 21 may be accommodated in the plurality of housings 221, 231, and 241, and the plurality of housings 221, 231, and 241 may be made of a synthetic resin material or a metal material.

The plurality of housings 221, 231, and 241 may include first to third housings 221, 231, and 241 that may be successively accommodated. For example, the first to third housings 221, 231, and 241 may be in a cylindrical shape that corresponds to the suction force generator 21.

Further, the outer diameter of the first housing 221 may be set to be smaller than the inner diameter of the second housing 231 and the outer diameter of the second housing 231 may be set to be smaller than the inner diameter of the third housing 241 so that the first to third housings 221, 231, and 241 can be successively accommodated.

The suction force generator 21 may be accommodated in the first housing 221, the first housing 221 may be accommodated in the second housing 231, and the second housing 231 may be accommodated in the third housing 241.

The first housing 221 may include a first opening 221*a* that is open toward one side thereof so as to accommodate the suction force generator 21 therein, and as illustrated in FIG. 3, the direction of the first opening 221*a* may coincide with the direction of the intake hole 211 of the suction force generator 21.

The second housing 231 may include a second opening 231*a* that is open toward one side thereof so as to accommodate the first housing 221 therein, and the direction of the second opening 231*a* may also coincide with the direction of the intake hole 211 and the first opening 221*a*.

Further, the third housing 241 may include a third opening 241*a* that is open toward one side thereof so as to accommodate the second housing 231 therein, and the direction of the third opening 241*a* may also coincide with the direction of the intake hole 211 and the second opening 231*a*.

In addition, the first housing 221 may include a first discharge hole 2211 for discharging the air that is discharged from the exhaust holes 212 of the suction force generator 21 to an outside of the first housing 221.

Further, the second housing 231 may include a second discharge hole 2311 for discharging the air that flows in through the first discharge hole 2211 to an outside, and the third housing 241 may include a third discharge hole 2411 for discharging the air that flows in through the second discharge hole 2311 to an outside.

Accordingly, the air that is discharged through the exhaust holes 212 may be successively discharged to the outside along the first to third housings 221, 231, and 241 through the first to third discharge holes 2211, 2311, and 2411.

The suction unit 20 may include an exhaust passage that includes a first section in which the air that is discharged from the exhaust holes 212 is directed to the first discharge hole 2211, a second section in which the air is directed from the first discharge hole 2211 to the second discharge hole 2311, and a third section in which the air is directed from the second discharge hole 2311 to the third discharge hole 2411.

The first section may be formed in the first housing 221, the second section may be formed between the outer surface of the first housing 221 and the inner surface of the second housing 231, and the third section may be formed between the outer surface of the second housing 231 and the inner surface of the third housing 241.

As described above, the exhaust passage that includes the plurality of sections may be formed through space between the outer surfaces and the inner surfaces of the adjacent housings, and thus noise can be prevented from leaking to the outside by minimizing the size of the suction unit 20 and extending the length of the exhaust passage at the same time.

Specifically, referring to FIGS. 3 to 5, the first discharge hole 2211 may be arranged on a bottom surface of the first housing 221 that is opposite to the intake hole 211 of the suction force generator 21.

The first discharge hole 2211 may include a plurality of through-holes that are distributed on the bottom surface of the first housing 221.

Accordingly, the air that is sucked through the intake hole 211 may be discharged through the exhaust holes 212, and then may be discharged to the outside of the first housing 221 through the first section that is directed to the first discharge hole 2211 arranged on the bottom surface of the first housing 221.

In addition, a first sound-absorbing member 251 configured to absorb the sound of the air that is discharged to the outside of the first housing 221 through the first discharge hole 2211 may be arranged in the first section.

The first sound-absorbing member 251 may be made of a sound-absorbing material, such as polyurethane, and can absorb the sound of the air that passes through the first sound-absorbing member 251.

For example, the first sound-absorbing member 251 may be made of a porous material, for example, a porous material in which a ventilation pore satisfies 45 to 75 PPI (Pore Per Inch), and preferably, the first sound-absorbing member 251 may be made of polyurethane foam having a ventilation pore of 60 PPI.

If the ventilation pore of the first sound-absorbing member 251 is equal to or smaller than a constant numerical value (e.g., 45 PPI), it becomes difficult for the air to pass through the first sound-absorbing member 251, and thus the flow rate of the air that passes through the first sound-absorbing member 251 is reduced to deteriorate the suction force of the suction unit 20.

In addition, if the ventilation pore of the first sound-absorbing member 251 is larger than the constant numerical value (e.g., 75 PPI), the absorption rate of the noise through the first sound-absorbing member 251 may deteriorate.

The first sound-absorbing member 251 is not limited to the above-described ventilation pore and material, but may be made of various materials which can pass the air therethrough and can obtain a predetermined sound-absorbing effect as the sound of the passing air is attenuated through scattering.

Through this, while the non-uniform air flow that is discharged from the exhaust holes 212 passes through the first sound-absorbing member 251, the noise can be reduced, and the flow rate and pressure of the air can become uniform.

As illustrated in FIGS. 4 and 5, the first sound-absorbing member 251 may be arranged between the suction force generator 21 and the bottom surface of the first housing 221, and may cover the bottom surface of the first housing 221.

For example, the thickness of the first sound-absorbing member 251 may be about 10 mm, and may correspond to the thickness of a second anti-vibration member 272.

Accordingly, the first sound-absorbing member 251 may cover the first discharge hole 2211, and the whole amount of air that is discharged to the second housing 231 through the first discharge hole 2211 may pass through the first sound-absorbing member 251.

Through this, the noise that is generated due to the air that flows through the first section may be primarily absorbed.

Further, since the first discharge hole 2211 is arranged on the bottom surface of the first housing 221, the direction of the air that is sucked through the intake hole 211 may coincide with the direction of the air that is discharged to the outside of the first housing 221 through the first discharge hole 2211 after passing through the first section.

Accordingly, the air that moves through the first section passes through the first sound-absorbing member 251 without colliding with the inner surface of the first housing 221, and thus the noise that may be generated due to the air flow through the first section can be absorbed by the first sound-absorbing member 251 within the shortest time.

In addition, the first sound-absorbing member 251 can be modified in various shapes that can cover the first discharge hole 2211 in accordance with the location of the first discharge hole 2211.

Further, since the first sound-absorbing member 251 supports one side of the suction force generator 21, it may absorb vibration that is generated from the suction force generator 21.

The second discharge hole 2311 may be arranged on the side surface of the second housing 231 that is vertical to the bottom surface of the first housing 221. In addition, the second discharge hole 2311 may include a plurality of through-holes.

Accordingly, the air that flows into the second housing 231 through the first discharge hole 2211 may be discharged to the outside of the second housing 231 through the second section that is measured from the first discharge hole 2211 to the second discharge hole 2311.

As described above, since the first discharge hole 2211 is arranged on the bottom surface of the first housing 221 and the second discharge hole 2311 is arranged on the side surface of the second housing 231, the air that is discharged from the first discharge hole 2211 may switch its direction on the bottom surface of the second housing 231.

Accordingly, as illustrated in FIGS. 4 and 5, the direction of the air that flows through the second section that is directed to the second discharge hole 2311 arranged on the side surface of the second housing 231 may become opposite to the direction of the air that flows through the first section.

In addition, the suction unit 20 may further include a hitting noise reflector 261 that is arranged on the bottom surface of the second housing 231 that faces the first discharge hole 2211.

The hitting noise reflector 261 may reflect the hitting noise of the air that is directed from the first discharge hole 2211 to the bottom surface of the second housing 231.

The hitting noise reflector 261 cannot pass the air therethrough, but can reflect the colliding air and the hitting noise that is generated due to the colliding air.

The hitting noise reflector 261 may be made of a sound-absorbing material that does not pass the air therethrough. For example, the hitting noise reflector 261 may be made of a rubber material, and preferably, NR30.

As described above, since the air that is discharged from the first discharge hole 2211 should switch its direction on the bottom surface of the second housing 231 in order to flow through the second section, it may apply an impact onto the bottom surface of the first housing 231, and thus the hitting noise may be generated due to the applied impact.

Accordingly, since the hitting noise reflector 261 that can reflect the hitting noise is arranged on the bottom surface of the second housing 231, the hitting noise can be prevented from being generated due to direct collision of the air with the second housing 231.

In order to efficiently reflect the hitting noise, the hitting noise reflector 261 may cover the whole of the bottom surface of the second housing 231.

In addition, a second sound-absorbing member 252 may be arranged in the second section to absorb the sound of the air that is discharged to the outside of the second housing 231 through the second discharge hole 2311.

The second sound-absorbing member 251 may be made of a sound-absorbing material, such as polyurethane, and may be made of the same material as the first sound-absorbing member 251. In addition, the second sound-absorbing member 252 may be formed of various materials that can absorb the sound of the passing air without deteriorating the air flow.

As illustrated in FIGS. 4 and 5, the second sound-absorbing member 252 may be configured to surround the outer surface of the first housing 221.

In addition, the second sound-absorbing member 252 may also come in contact with the inner surface of the second housing 231 simultaneously with surrounding the outer surface of the first housing 221.

Through this, the exhaust passage that is formed between the outer surface of the first housing 221 and the inner surface of the second housing 231 may be filled with the second sound-absorbing member 252.

Accordingly, the whole amount of the air that flows through the second section may pass through the second sound-absorbing member 252, and through this, the noise that is generated from the air that flows through the second section may be secondarily absorbed.

In addition, vibration that is transferred from the first housing 221 to the second housing 231 through the second sound-absorbing member 252 may be absorbed.

Further, as illustrated in FIGS. 4 and 5, a space S, in which the second sound-absorbing member 252 is not arranged, may be provided between the hitting noise reflector 261 and the second sound-absorbing member 252.

The air, of which the flow direction is switched through being reflected by the hitting noise reflector 261, may be mixed in the space S, and then may stably pass through the second sound-absorbing member 252.

Through this, the noise of the air that passes through the second sound-absorbing member 252 can be reduced more effectively.

Further, the second sound-absorbing member 252 may cover the second discharge hole 2211.

Accordingly, the whole amount of the air that is discharged to the third housing 241 through the second discharge hole 2211 may pass through the second sound-absorbing member 252.

In addition, since the second discharge hole 2311 is arranged on the side surface of the second housing 231, the air that flows through the second section may switch its direction in the process of discharging the air through the second discharge hole 2311.

For example, as illustrated in FIGS. 4 and 5, the air that flows through the second section may vertically switch its direction to pass through the second discharge hole 2311.

As described above, since the second section may be formed between the outer surface of the first housing 221 and the inner surface of the second housing 231, the length of the second section may be set to be longer than the length of the first section.

Through this, the section in which the air passes through the second sound-absorbing member 252 can be set to be longer than the section in which the air passes through the first sound-absorbing member 251, and thus the noise of the air that passes through the second sound-absorbing member 252 can be absorbed more efficiently.

Further, the second discharge hole 2311 may be arranged more adjacent to the second opening 231*a* than the bottom surface of the second housing 231.

Through this, the length of the second section can be extended, and since the section in which the air passes through the second sound-absorbing member 252 is extended long, the noise of the air that flows through the second section can be absorbed more efficiently.

Further, as illustrated in FIG. 3, the plurality of through-holes of the second discharge hole 2311 may be in the shape of an elongated hole that is formed to extend along the outer periphery of the second housing 231, and the occupation ratio of the second discharge hole 2311 on the side surface of the second housing 231 may be set to be lower than the contact ratio of the second sound-absorbing member 252 on the inner surface of the second housing 231.

Through this, the air that passes through the second sound-absorbing member 252 can be uniformly discharged through the plurality of through-holes of the second discharge hole 2311.

The third discharge hole 2411 may be arranged on the side surface of the third housing 241, and may include a plurality of through-holes.

Since the third housing 241 forms an external appearance of the suction unit 20 and the air is discharged to the outside of the first main body 11 through the third discharge hole 2411, the third discharge hole 2411 may be arranged in an outside direction of the first main body 11.

Although FIG. 3 exemplarily illustrates that the plurality of through-holes of the third discharge hole 2411 are arranged only on a part of the side surface of the third housing 2411, the third discharge hole 2411 may be arranged in various locations where the air can be discharged to the outside of the vacuum cleaner 1.

Further, since the third sound-absorbing member is arranged even in the third section that is directed from the second discharge hole 2311 to the third discharge hole 2411, the noise of the air that flows through the third section can be absorbed.

Like this, the air that is sucked into the suction unit 20 may be discharged to the outside through the exhaust passage that includes the first to third sections, and the length of the exhaust passage that includes the first to third sections may be formed to be longer than the exhaust passage in the prior art.

Through this, the noise that is caused by the air flow can be prevented from being directly transferred to the outside of the suction unit 20.

Further, since the suction force generator 21 is accommodated through the first to third housings 221, 231, and 241 that are successively accommodated, the noise that is generated from the suction force generator 21 can be efficiently prevented from being transferred to the outside of the suction unit 20 through a multilayer structure.

In addition, the flow noise of the air that flows to the exhaust passage through the first and second sound-absorbing members 251 and 252 arranged in the first and second sections can be efficiently absorbed.

Further, in constructing the exhaust passage that includes the first to third sections, the hitting noise reflector 251 is provided to reflect the hitting noise that may be generated due to the switching of the direction of the exhaust passage, and thus the hitting noise that may be generated due to direct collision of the air with the housing can be prevented from being generated.

The first housing 221 may include a first lid 222 configured to cover a part of the first opening 221*a* in which the suction force generator 21 is accommodated.

The first lid 222 may be coupled to the first housing 221, and may include a first lid hole 2221 that can connect with the first opening 221*a* and the intake hole 211.

Accordingly, the external air can be sucked into the suction force generator 21 through the first lid hole 2221, the first opening 221*a*, and the intake hole 211.

Further, the second housing 231 may include a second lid 232 configured to cover a part of the second opening 231*a*. The second lid 232 may be coupled to the second housing 231, and may include a second lid hole 2321 that can connect with the second opening 231*a* and the intake hole 211.

The second lid 232 may further include a ring-shaped packing member 233 that can be coupled to the outer periphery of the second lid 232.

The packing member 233 may be made of an elastic material, such as rubber, so as to absorb vibration that is transferred from the second lid 232, and may include a plurality of packing lids 2331 arranged along the outer periphery thereof.

The packing lids 2331 may be also made of an elastic material, such as rubber, and may support the inside of a third lid 2142 to be described later so as to reduce the vibration that is transferred from the second lid 232 to the third lid 242.

Further, the packing member 233 that includes the plurality of packing lids 2331 may seal up a gap between the second lid 232 and the inside of the third lid 242 so that the air that flows in through a third lid hole 2421 of the third lid 242 flows into the intake hole 211 through the second lid hole 2321 without leaking to the outside of the second lid 232.

In addition, the third housing 241 may include the third lid 242 that covers a part of the third opening 241*a*. The third lid 242 may be coupled to the third housing 241, and may include the third lid hole 2421 that can connect with the third opening 241*a* and the intake hole 211.

As illustrated in FIG. 2, the third housing 241 and the third lid 242 may form an external appearance of the suction unit 20, and in the case where the dust collection unit 13 is separated from the first main body 11, the third lid hole 2421 of the third lid 242 may be exposed to the outside.

As illustrated in FIGS. 2 and 3, the third lid hole 2421 may be composed of a plurality of through-holes, and in the case where the dust collection unit 13 is separated from the first main body 11, the third lid hole 2421 can prevent a user's hand from entering into the suction unit 20.

The suction unit 20 may include a plurality of anti-vibration members 271, 272, 273, and 274 that are made of an elastic material, such as rubber, so as to absorb the vibration.

The plurality of anti-vibration members 271, 272, 273, and 274 may be arranged between the suction force generator 21 and the first housing 221, between the first housing 221 and the second housing 231, and between the second housing 231 and the third housing 241.

Through this, the vibration that is generated from the suction force generator 21 can be prevented from being transferred to the outside of the suction unit 20 through the first to third housings 221, 231, and 241.

The plurality of anti-vibration members 271, 272, 273, and 274 may include first to fourth anti-vibration members 271, 272, 273, and 274.

In addition, each of the first to fourth anti-vibration members 271, 272, 273, and 274 may be composed of a plurality of anti-vibration members.

As illustrated in FIGS. 3 to 5, the first anti-vibration member 271 is in the shape of a cylinder through which the air can pass, and may be arranged to cover the impeller cover 2111 along the outer periphery of the first lid hole 2221 through combination with the first lid 222.

Through this, the vibration that may be transferred from the impeller cover 2111 to the first lid 222 may be reduced through the first anti-vibration member 271.

In addition, the first anti-vibration member 271 may seal up a gap between the impeller cover 2111 and the first lid hole 2221 of the first lid 222, and thus the gap between the intake hole 211 and the first opening 221*a* can be sealed.

Through this, the air that is sucked into the suction unit 20 may be sucked into the intake hole 211 without leaking to the gap between the intake hole 211 and the first opening 221*a*.

Further, the first anti-vibration member 271 may seal up a gap between the first lid hole 2221 of the first lid 222 and the second lid hole 2321 of the second lid 232, and thus the gap between the first opening 221*a* and the second opening 231*a* may be sealed.

Through this, the air that is sucked into the suction unit 20 may be sucked into the intake hole 211 without leaking to the gap between the first opening 221*a* and the second opening 231*a*.

In addition, the first anti-vibration member 271 may seal up a gap between the second lid hole 2321 of the second lid 232 and the third lid hole 2421 of the third lid 242, and thus the gap between the second opening 231*a* and the third opening 241*a* may be sealed.

Through this, the air that is sucked into the suction unit 20 may be sucked into the intake hole 211 without leaking to the gap between the second opening 231*a* and the third opening 241*a*.

Like this, the first anti-vibration member 271 may absorb the vibration that may be transferred from the suction force generator 21 to the first to third housings 221, 231, and 241 and the first to third lids 222, 232, and 242, and may prevent the air that is sucked into the suction unit 20 from leaking without being inhaled into the intake hole 211 at the same time.

The second anti-vibration member 272 may be coupled to the other end of the suction force generator 21 that is opposite to the intake hole 211 of the suction force generator 21.

The second anti-vibration member 272 may be arranged between the suction force generator 21 and the bottom surface of the first housing 221 to absorb the vibration that is transferred from the suction force generator 21 to the bottom surface of the first housing 221.

In addition, the first sound-absorbing member 251 may include a coupling hole 2511 having a shape that corresponds to the shape of the second anti-vibration member 272, and the second anti-vibration member 272 may be penetratingly coupled to the coupling hole 2511 of the first sound-absorbing member 251.

Like this, the first housing 221 may be configured to have a compact size through a coupling structure of the first sound-absorbing member 251 and the second anti-vibration member 272.

Further, the third anti-vibration member 273 may be arranged between the bottom surface of the first housing 221 and the bottom surface of the second housing 231.

The third anti-vibration member 273 may absorb vibration that is transferred from the bottom surface of the first housing 221 to the bottom surface of the second housing 231.

In addition, the hitting noise reflector 261 that is arranged on the bottom surface of the second housing 231 may include a coupling hole 2611 having a shape that corresponds to the shape of the third anti-vibration member 273, and the third anti-vibration member 273 may be penetratingly coupled to the coupling hole 2611 of the hitting noise reflector 261.

Like this, the second housing 231 may be configured to have a compact size through a coupling structure of the hitting noise reflector 261 and the third anti-vibration member 273.

The fourth anti-vibration member 274 may be arranged between the bottom surface of the second housing 231 and the bottom surface of the third housing 241.

Through this, the fourth anti-vibration member 274 may absorb vibration that is transferred from the bottom surface of the second housing 231 to the bottom surface of the third housing 241.

Further, as illustrated in FIG. 3, the fourth anti-vibration member 274 may be composed of a plurality of anti-vibration members that are coupled to the second housing 231 at predetermined intervals.

Like this, the suction unit 20 can efficiently absorb the vibration through the plurality of anti-vibration members 271, 272, 273, and 274 arranged between the suction force generator 21 and the first to third housings 221, 231, and 241.

Hereinafter, referring to FIGS. 4 and 5, a flow of air, which flows into the suction unit 20 and is discharged to the outside, will be described.

The air that flows into the suction force generator 21 through the intake hole 211 is discharged through the exhaust hole 212 of the suction force generator 21, and the air that is discharged from the suction force generator 21 flows along the first section that is directed to the first discharge hole 2211 that is arranged on the bottom surface of the first housing 221.

The air that flows through the first section passes through the first sound-absorbing member 251 that is arranged in the first section, and thus the flow noise of the air can be primarily absorbed. The air that passes through the first sound-absorbing member 251 may flow into the second housing 231 after passing through the first discharge hole 2211.

The air that passes through the first discharge hole 2211 flows toward the bottom surface of the second housing 231 that faces the first discharge hole 2211, and then is reflected by the hitting noise reflector 261 that is arranged on the bottom surface of the second housing 231 to switch the flow direction thereof to an opposite direction.

The direction-switched air flows along the second section that is directed to the second discharge hole 2311.

The air that flows through the second section passes through the second sound-absorbing member 252 that is arranged in the second section to surround the outer surface of the first housing 231, and thus the flow noise of the air can be secondarily absorbed.

The air that passes through the second sound-absorbing member 252 may switch the flow direction to a vertical direction as passing through the second discharge hole 2311.

The air that flows from the second discharge hole 2311 to the inside of the third housing 241 may flow along the third section that is directed to the third discharge hole 2411, and may be discharged to the outside of the suction unit 20 through the third discharge hole 2411. Through this, the air may be discharged to the outside of the vacuum cleaner 1.

Figure 6:
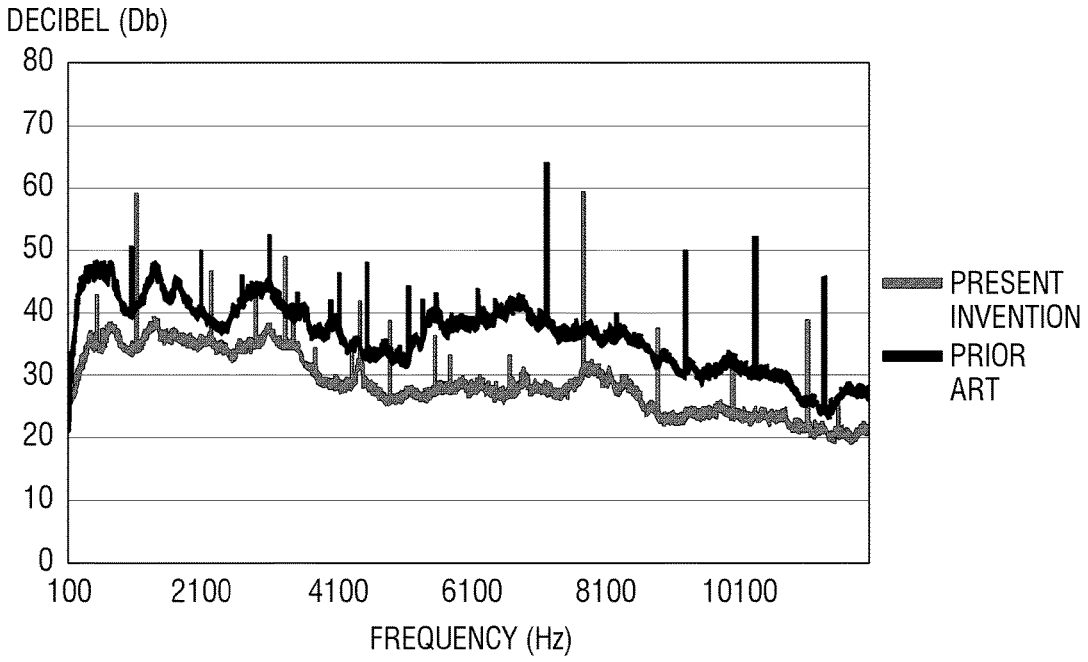
FIG. 6 is a graph comparatively illustrating levels of sound generated when a vacuum cleaner according to an embodiment of the present disclosure and a vacuum cleaner in the prior art are operated.

FIG. 6 is a graph comparatively illustrating levels (decibel (dB)) of sound generated when a vacuum cleaner according to an embodiment of the present disclosure and a vacuum cleaner in the prior art are operated.

As illustrated in FIG. 6, according to the vacuum cleaner 1 according to an embodiment of the present disclosure that includes the suction unit 20 adapting the first to third housings 221, 231, and 241, the first sound-absorbing member 251, the hitting noise reflector 261, the second sound-absorbing member 252, and the plurality of anti-vibration members 271, 272, 273, and 274, it can be confirmed that the generated noise has been considerably reduced in comparison to the prior art.

In addition, the vacuum cleaner 1 according to an embodiment of the present disclosure can efficiently reduce the noise of all sound bands in comparison to the prior art.

Figure 7:
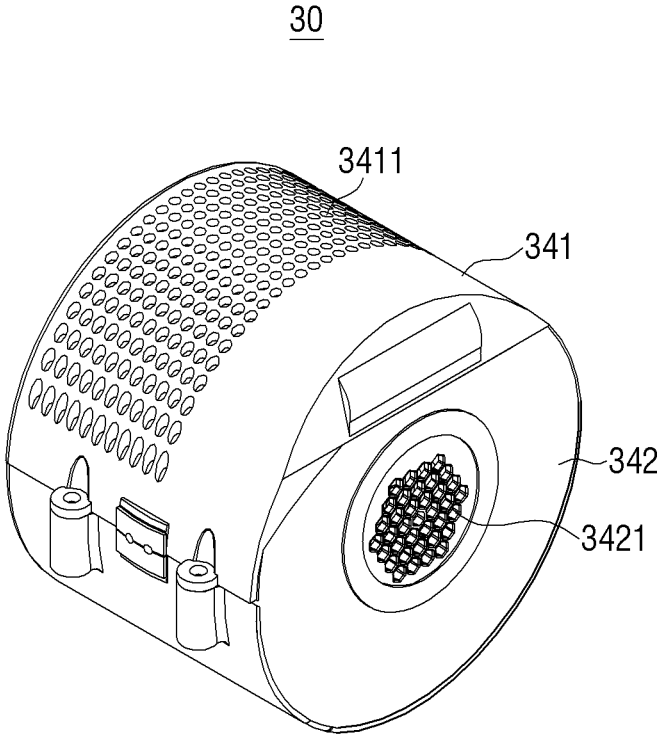
FIG. 7 is a perspective view illustrating a suction unit of a vacuum cleaner according to another embodiment of the present disclosure.
Figure 8:
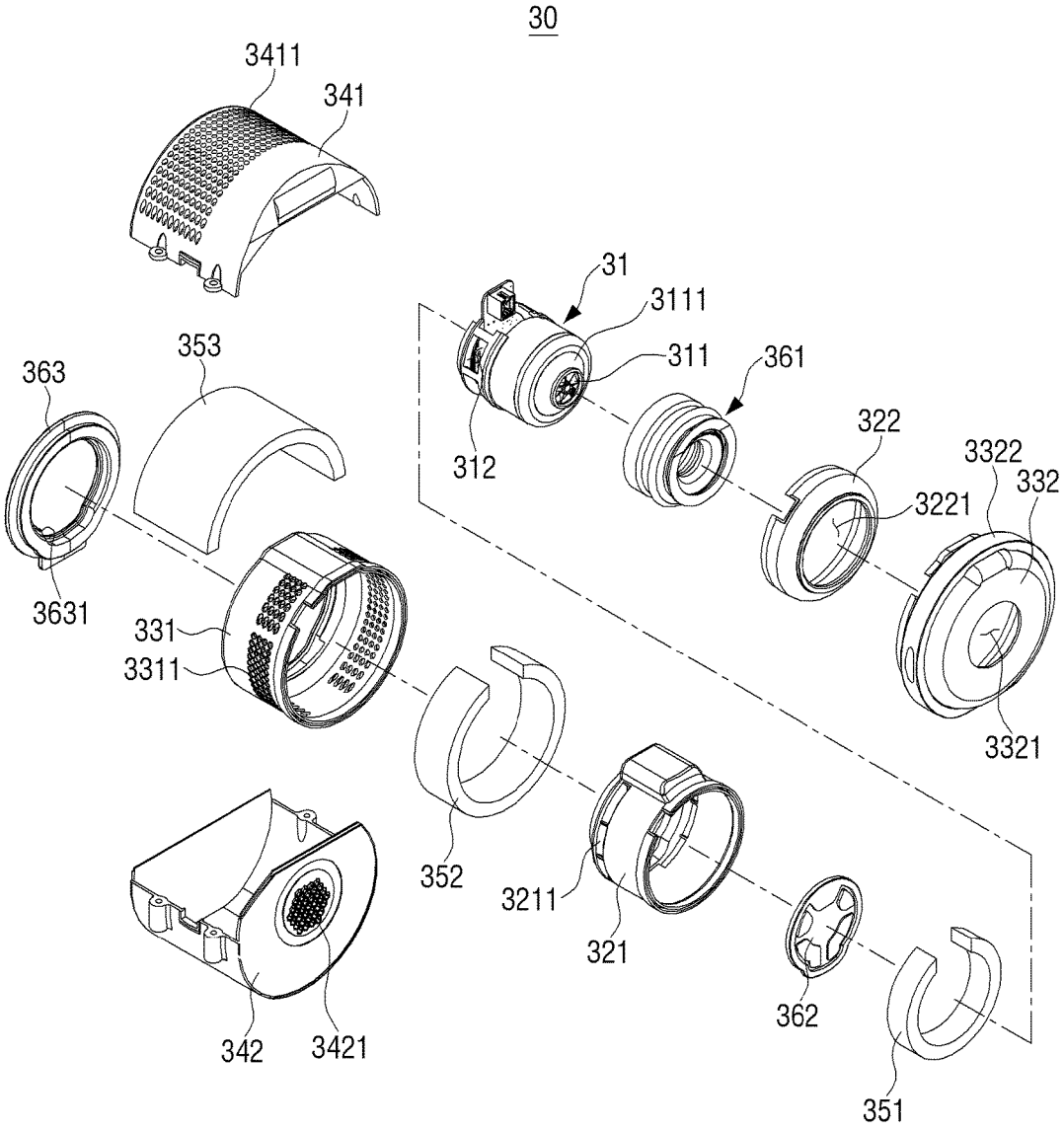
FIG. 8 is an exploded perspective view of a suction unit illustrated in FIG. 7.
Figure 9:
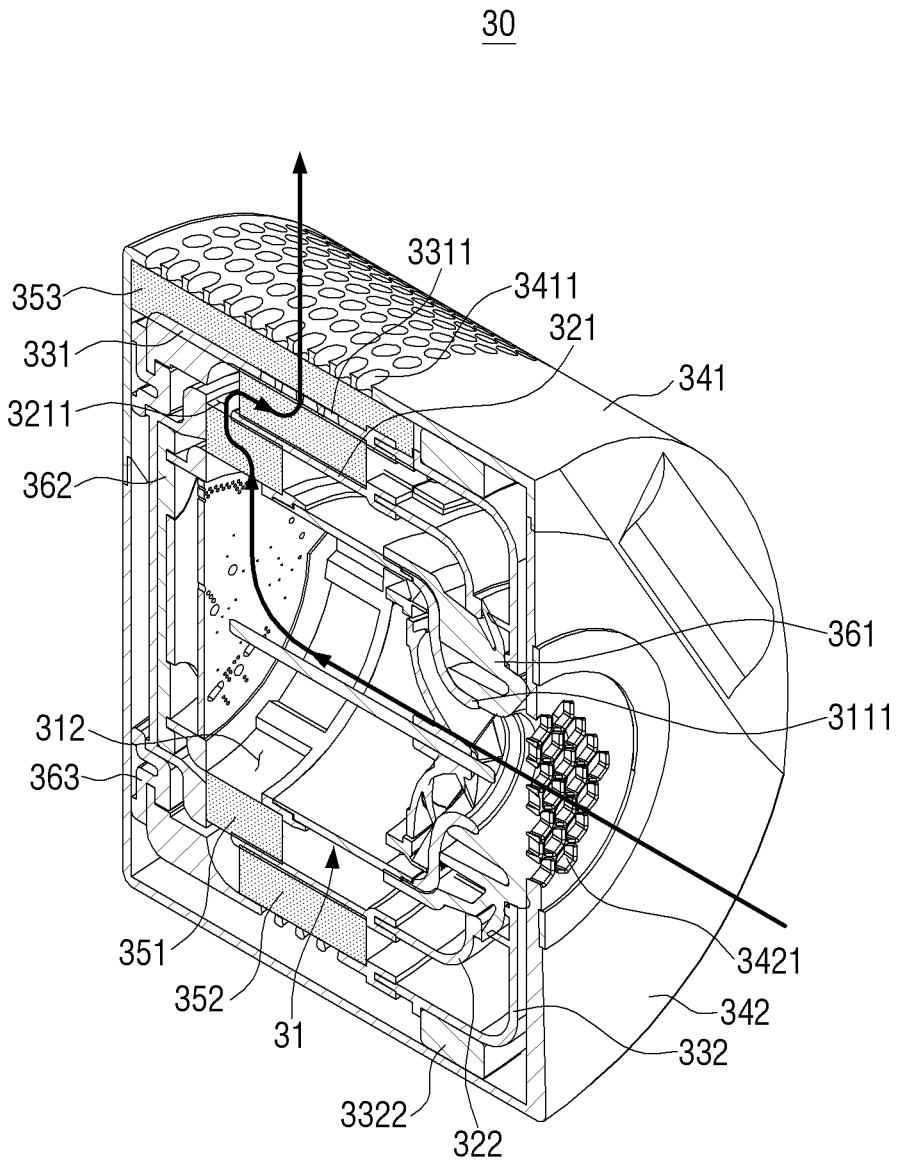
FIG. 9 is a cross-sectional view illustrating a passage of a suction unit illustrated in FIG. 7.
Figure 10:
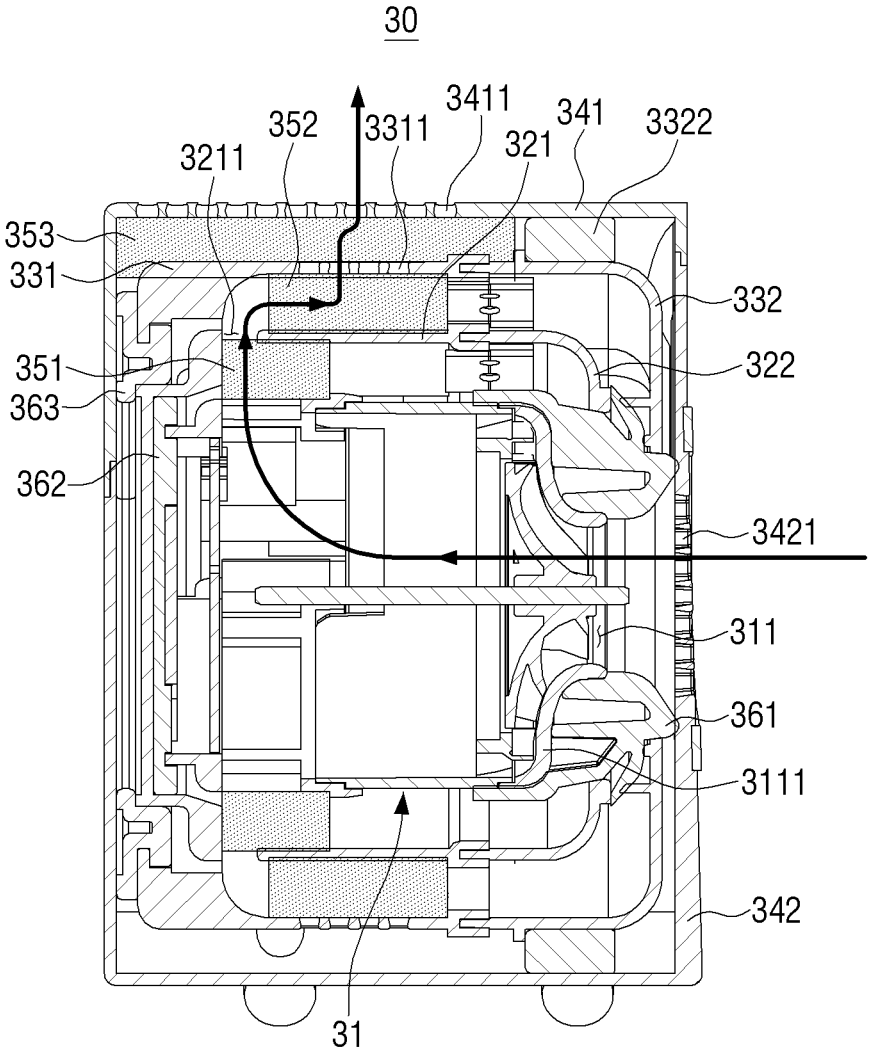
FIG. 10 is a cross-sectional view of a passage of a suction unit illustrated in FIG. 9 as seen from a different direction.

FIG. 7 is a perspective view illustrating a suction unit 30 of a vacuum cleaner according to another embodiment of the present disclosure. FIG. 8 is an exploded perspective view of a suction unit 30, and FIGS. 9 and 10 are cross-sectional views illustrating a passage of a suction unit 30 through which air flows.

Through reduction of the length of a suction unit 30 according to another embodiment of the present disclosure, a vacuum cleaner that includes the suction unit 30 may be configured to have a compact size.

Hereinafter, referring to FIGS. 7 to 10, the detailed configuration of a suction unit 30 will be described.

Since the overall configuration of the suction unit 30 is the same as or similar to the configuration of the suction unit 20 according to an embodiment of the present disclosure as illustrated in FIGS. 2 to 5, the duplicate explanation thereof will be omitted.

The suction unit 30 may include a suction force generator 31, a plurality of housings 321, 331, 341, and 342 configured to successively accommodate the suction force generator 31, a plurality of sound-absorbing members 351, 352, and 353, and a plurality of anti-vibration members 361, 362, and 363.

Air that is sucked into the suction force generator 31 through an intake hole 311 of the suction force generator 31 may be discharged through a plurality of exhaust holes 312 formed on a side surface of the suction force generator 31.

The air that is discharged through the exhaust holes 312 may flow into the first housing 321, and may be discharged to an outside of the first housing 321 through a first discharge hole 3211 that is formed on the side surface of the first housing 321.

In addition, as illustrated in FIGS. 8 to 10, the first discharge hole 3211 may be arranged on the side surface of the first housing 321 that is adjacent to the exhaust holes 312 of the suction force generator 31.

The first sound-absorbing member 351 may be arranged inside the first housing 321, and may be configured to surround an outer surface of the suction force generator 31 to cover the plurality of exhaust holes 312 of the suction force generator 31.

In addition, the first sound-absorbing member 351 may cover the plurality of exhaust holes 312 and the first discharge hole 3211 at the same time.

Accordingly, the air that is discharged from the exhaust holes 312 and flows through a first section that is directed to the first discharge hole 3211 may be discharged from the exhaust holes 312 and may pass through the first sound-absorbing member 351 to efficiently absorb noise at the same time.

In addition, since the air is discharged in a direction of an outer diameter of the first housing 321, the length of the first housing 321 can be reduced.

The second housing 331 may accommodate the first housing 321 therein, and may include a second discharge hole 3311 that discharges the air that flows in through the first discharge hole 3211 to an outside of the second housing 331.

The second discharge hole 3311 may be arranged on a side surface of the second housing 331, and may include a plurality of through-holes.

The second sound-absorbing member 352 may be arranged in a second section that is directed from the first discharge hole 3211 to the second discharge hole 3311.

The second sound-absorbing member 352 may be configured to surround an outer surface of the first housing 321, and may be configured to surround the whole outer surface of the first housing 321.

In addition, the second sound-absorbing member 352 may also come in contact with the inner surface of the second housing 331 simultaneously with surrounding the outer surface of the first housing 321.

Through this, the second section between the outer surface of the first housing 321 and the inner surface of the second housing 331 may be filled with the second sound-absorbing member 352, and the second sound-absorbing member 352 may cover the second discharge hole 3311.

Accordingly, the whole amount of the air that flows through the second section may pass through the second sound-absorbing member 352, and through this, the noise that is generated from the air that flows through the second section can be absorbed.

In addition, since the plurality of through-holes of the second discharge hole 3311 are arranged along the length direction of the second sound-absorbing member 352 through which the air passes, the air that passes through the second sound-absorbing member 352 may be distributed through the plurality of through-holes and may be discharged to the outside of the second housing 331.

As illustrated in FIG. 8, the third housings 341 and 342 may be configured through combination of an upper housing 341 and a lower housing 342.

The lower housing 342 may include a lower intake hole 3421 that is composed of a plurality of through-holes that can connect with a dust collector unit (not illustrated), and air may flow into the third housings 341 and 342 through the lower intake hole 3421.

Like this, since the third housings 341 and 342 are configured through combination of the upper housing 341 and the lower housing 342, constituent elements that are arranged inside the third housings 341 and 342 can be easily assembled.

As illustrated in FIGS. 8 to 10, a third discharge hole 3411 that is composed of a plurality of through-holes may be provided on a curved surface portion of the upper housing 341, and the lower housing 342 does not include a separate discharge hole that can discharge the air that flows into the third housings 341 and 342.

Accordingly, the air that flows into the third housings 341 and 342 may be discharged only toward upper portions of the third housings 341 and 342.

The third sound-absorbing member 353 may be arranged inside the third housings 341 and 342.

Since the air that flows into the third housings 341 and 342 is discharged to the outside of the third housings 341 and 342 through the third discharge hole 3411 arranged on the upper housing 341, the third sound-absorbing member 353 may be configured to surround only a part of the outer surface of the second housing 331 so as to cover the third discharge hole 3411.

For example, the third sound-absorbing member 353 may be in an arch shape that corresponds to a part of an outer periphery of the second housing 331 to surround a part of the second discharge hole 3311.

The plurality of through-holes of the third discharge hole 3411 may be arranged at predetermined intervals on the whole of the curved surface portion of the upper housing 341, and the third sound-absorbing member 353 may cover the plurality of through-holes of the third discharge hole 3411.

Through this, even if the third sound-absorbing member 353 surrounds only a part of the second discharge hole 3311, the air that passes through the third sound-absorbing member 353 is distributed and discharged through the plurality of through-holes that are arranged on the whole of the curved surface portion of the upper housing 341, and thus noise can be efficiently reduced.

In addition, the suction unit 30 may further include first and second lids 322 and 332 that cover part of the respective openings of the first and second housings 321 and 331, and the second lid 332 may further include a packing member 3322 that can be coupled to an outer periphery of the second lid 332.

Since the configuration of the first and second lids 322 and 332 is similar to the configuration of the first and second lids 222 and 232 as illustrated in FIG. 3, the duplicate explanation thereof will be omitted.

The suction unit 30 may include a plurality of anti-vibration members 361, 362, and 363 that are made of an elastic material, such as rubber, so as to absorb vibration.

The plurality of anti-vibration members 361, 362, and 363 may include first to third anti-vibration members 361, 362, and 363.

The first anti-vibration member 361 is in the shape of a cylinder through which air can pass, and may be arranged to cover an impeller cover 3111. Vibration that may be transferred from the impeller cover 3111 to the first lid 222 can be reduced through the first anti-vibration member 361.

The second anti-vibration member 362 may be arranged between the suction force generator 31 and the bottom surface of the first housing 321 to absorb the vibration that is transferred from the suction force generator 31 to the bottom surface of the first housing 321.

Since the configuration and function of the first and second anti-vibration members 361 and 362 are similar to those of the first and second anti-vibration members 271 and 272 as illustrated in FIG. 3, the duplicate explanation thereof will be omitted.

The second housing 331 may include an opening formed on the bottom surface of the second housing 331, and the opening that is formed on the bottom surface of the second housing 331 may be opened/closed through the bottom surfaces of the third housings 341 and 342.

The third anti-vibration member 363 may be in the shape of a ring, and may be arranged on the bottom surface of the second housing 331. The third anti-vibration member 363 may absorb the vibration that is transferred from the second housing 331 to the third housings 341 and 342 and may seal up the gap between the opening on the bottom surface of the second housing 331 and the third housings 341 and 342 at the same time.

In addition, the third anti-vibration member 363 may support the bottom surface of the first housing 321 that is arranged on the opening of the second housing 331 through an inner peripheral portion 3631 that projects toward the inner periphery, and may absorb the vibration that may be transferred from the bottom surface of the first housing 321.

Through this, the length of the suction unit 30 can be minimized, and the vacuum cleaner 1 that includes the suction unit 30 can be configured to be more compact.

Although the various embodiments of the present disclosure have been individually described, it is not necessary to solely implement the respective embodiments, but the configurations and operations of the respective embodiments may be implemented in combination with at least one of other embodiments.

While the invention has been shown and described with reference to certain embodiments thereof, it will be understood by those skilled in the art that various changes in form and detail may be made therein without departing from the spirit and scope of the present invention, as defined by the appended claims.

What is claimed is:

1. A vacuum cleaner comprising:

a main body;

a dust collector arranged in the main body to collect dust from air that flows into the main body along an intake passage; and a suction device arranged at a downstream that is lower than a location of the dust collector on the intake passage to provide a suction force, wherein the suction device includes:

a suction force generator, a first housing configured to accommodate the suction force generator, and including a first discharge hole provided in a bottom surface of the first housing and discharging the air sucked from the suction force generator to an outside, a second housing configured to accommodate the first housing, and including a second discharge hole provided in a side surface of the second housing and discharging the air that flows in from the first discharge hole to the outside, a third housing provided separately from the main body and configured to accommodate the second housing, and including a third discharge hole provided in a side surface of the third housing and discharging the air that flows in from the second discharge hole to the outside, a first sound absorbing member arranged in the bottom surface of the first housing, and a second sound absorbing member arranged between the side surface of the first housing and the side surface of the second housing, wherein the second sound absorbing member is in contact with an outer surface of the first housing and an inner surface of the second housing.

2. The vacuum cleaner as claimed in claim 1, wherein a first section is formed inside the first housing, a second section is formed between the outer surface of the first housing and the inner surface of the second housing, and the air that flows from the first section to the second section switches its flow direction.

3. The vacuum cleaner as claimed in claim 2, wherein a direction of the air that flows through the first section is opposite to a direction of the air that flows through the second section.

4. The vacuum cleaner as claimed in claim 2, wherein a length of the second section is longer than a length of the first section.

5. The vacuum cleaner as claimed in claim 2, wherein a direction of the air that is discharged through the second discharge hole is different from a direction of the air that flows through the second section.

6. The vacuum cleaner as claimed in claim 1, wherein the second discharge hole is arranged adjacent to a second opening of the second housing.

7. The vacuum cleaner as claimed in claim 6, wherein the first and second discharge holes comprise a plurality of through-holes, and the plurality of through-holes of the second housing are elongated holes that are formed to extend along an outer periphery of the second housing.

8. The vacuum cleaner as claimed in claim 1, wherein the first sound-absorbing member covers the bottom surface of the first housing.

9. The vacuum cleaner as claimed in claim 1, wherein the second sound-absorbing member surrounds the outer surface of the first housing to come in contact with the inner surface of the second housing.

10. The vacuum cleaner as claimed in claim 9, wherein the second sound-absorbing member covers the second discharge hole.

11. The vacuum cleaner as claimed in claim 1, further comprising a hitting noise reflector configured to cover a bottom surface of the second housing so as to reflect hitting noise of the air that is directed from the first discharge hole to the bottom surface of the second housing.

12. The vacuum cleaner as claimed in claim 1, further comprising at least one anti-vibration member arranged between the suction force generator and the first housing to absorb vibration that is transferred from the suction force generator to the first housing.

13. The vacuum cleaner as claimed in claim 12, wherein the anti-vibration member is arranged on one side of the first housing that is opposite to an intake hole of the suction force generator.

14. The vacuum cleaner as claimed in claim 1, further comprising at least one anti-vibration member arranged between the first housing and the second housing to absorb vibration that is transferred from the first housing to the second housing.

15. The vacuum cleaner as claimed in claim 14, wherein the anti-vibration member is arranged between a bottom surface of the second housing and a bottom surface of the first housing.

16. A vacuum cleaner comprising:

a main body;

a dust collector arranged in the main body to collect dust from air that flows into the main body along an intake passage; and a suction device arranged at a downstream that is lower than a location of the dust collector on the intake passage to provide a suction force, wherein the suction device includes:

a suction force generator, a first housing configured to accommodate the suction force generator, including a first discharge hole provided in a bottom surface of the first housing, and providing a first exhaust passage configured to guide the air sucked from the suction force generator to the first discharging hole, a second housing configured to accommodate the first housing, including a second discharge hole provided in a side surface of the second housing, and providing a second exhaust passage configured to guide the air that flows in from the first discharge hole to the second discharge hole, a third housing provided separately from the main body and configured to accommodate the second housing, and including a third discharge hole provided in a side surface of the third housing and discharging the air that flows in from the second discharge hole to the outside, a first sound absorbing member arranged in the bottom surface of the first housing, and a second sound absorbing member arranged between the side surface of the first housing and the side surface of the second housing, wherein the second sound absorbing member is in contact with an outer surface of the first housing and an inner surface of the second housing, and wherein the first and second exhaust passages are arranged to form a layer.

17. The vacuum cleaner as claimed in claim 16, wherein the second housing further comprises a hitting noise reflector arranged between the first exhaust passage and the second exhaust passage to reflect hitting noise of the air of which a flow direction is switched.

* * * * *